US011634662B2

(12) United States Patent
Boutique et al.

(10) Patent No.: US 11,634,662 B2
(45) **Date of Patent: *Apr. 25, 2023**

(54) LIQUID DETERGENT COMPOSITIONS WITH IMPROVED RHEOLOGY

(71) Applicant: The Procter & Gamble Company, Cincinnati, OH (US)

(72) Inventors: Jean-Pol Boutique, Gembloux (BE); Aicha Dkidak, Brussels (BE); Bill Karel Mahieu, Brussels (BE); Patrick Christopher Stenger, Fairfield, OH (US); Denis Alfred Gonzales, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 46 days.

This patent is subject to a terminal disclaimer.

(21) Appl. No.: 15/969,806

(22) Filed: May 3, 2018

(65) Prior Publication Data

US 2018/0320109 A1 Nov. 8, 2018

(30) Foreign Application Priority Data

May 5, 2017 (EP) ..... 17169644
Jan. 30, 2018 (EP) ..... 18154182

(51) Int. Cl.

| | |
|---|---|
| ***C11D 11/00*** | (2006.01) |
| ***C11D 1/831*** | (2006.01) |
| ***C11D 3/43*** | (2006.01) |
| ***C11D 3/37*** | (2006.01) |
| ***C11D 3/20*** | (2006.01) |
| ***C11D 1/94*** | (2006.01) |
| ***C11D 1/83*** | (2006.01) |
| ***C11D 1/37*** | (2006.01) |
| ***C11D 17/00*** | (2006.01) |
| *C11D 1/22* | (2006.01) |
| *C11D 1/72* | (2006.01) |
| *C11D 1/29* | (2006.01) |

(52) U.S. Cl.

CPC ..... *C11D 1/831* (2013.01); *C11D 1/37* (2013.01); *C11D 1/83* (2013.01); *C11D 1/94* (2013.01); *C11D 3/2017* (2013.01); *C11D 3/2044* (2013.01); *C11D 3/2086* (2013.01); *C11D 3/3757* (2013.01); *C11D 3/43* (2013.01); *C11D 11/0017* (2013.01); *C11D 17/0026* (2013.01); *C11D 1/22* (2013.01); *C11D 1/29* (2013.01); *C11D 1/72* (2013.01)

(58) Field of Classification Search

CPC ..... C11D 1/83; C11D 3/2017; C11D 3/201; C11D 1/831

See application file for complete search history.

(56) References Cited

U.S. PATENT DOCUMENTS

| | | | | |
|---|---|---|---|---|
| 3,856,695 | A | 12/1974 | Geiss et al. | |
| 4,561,991 | A | 12/1985 | Herbots et al. | |
| 5,608,118 | A | 3/1997 | Dahlgren et al. | |
| 5,661,121 | A | 8/1997 | Dahlgren et al. | |
| 5,674,645 | A | 10/1997 | Amatucci et al. | |
| 5,968,888 | A | 10/1999 | Blandiaux | |
| 6,037,317 | A * | 3/2000 | Rapisarda | C11D 1/83 510/280 |
| 6,989,360 | B2 | 1/2006 | Danner et al. | |
| 2004/0142846 | A1 | 7/2004 | Hines et al. | |
| 2009/0029899 | A1 | 1/2009 | Grainger et al. | |
| 2011/0146001 | A1* | 6/2011 | Woo | C11D 3/50 8/137 |
| 2012/0222348 | A1 | 9/2012 | Bohnke | |
| 2012/0252716 | A1 | 10/2012 | Barnabas et al. | |
| 2015/0353869 | A1* | 12/2015 | Stenger | C11D 17/042 510/324 |
| 2017/0015949 | A1* | 1/2017 | Johnson | C11D 3/38636 |
| 2017/0087260 | A1 | 3/2017 | Tuerler et al. | |
| 2017/0145345 | A1* | 5/2017 | Gonzales | B08B 1/006 |
| 2017/0275566 | A1* | 9/2017 | Scialla | C11D 11/0017 |
| 2018/0320108 | A1 | 11/2018 | Boutique et al. | |

FOREIGN PATENT DOCUMENTS

| | | | |
|---|---|---|---|
| DE | 4021265 | A1 | 1/1992 |
| EP | 0666308 | A2 | 8/1995 |
| WO | 9919449 | A1 | 4/1999 |
| WO | 03006734 | A2 | 1/2003 |
| WO | 2012117004 | A2 | 9/2012 |

OTHER PUBLICATIONS

U.S. Appl. No. 15/969,802, filed May 3, 2018, Jean Pol Boutique.
Search_report for EP application No. 17169631.3-1375, dated Nov. 16, 2017, 9 pages.
SEarch_report for EP application No. 17169644.6, dated Nov. 8, 2017, 12 pages.
All Office Actions; U.S. Appl. No. 15/969,802.
International Search Report and Written Opinion for PCT/US2018/030755 dated Aug. 16, 2018, 16 pages.
Extended European Search Report and Search Opinion; Application No. 18154182.2; dated Aug. 23, 2018; 10 pages.

* cited by examiner

*Primary Examiner* — Necholus Ogden, Jr.

(57) ABSTRACT

A composition that includes of detersive surfactant, external structurant or thickener, and C4-C10 alkyl branched alcohol.

11 Claims, No Drawings

LIQUID DETERGENT COMPOSITIONS WITH IMPROVED RHEOLOGY

FIELD OF THE INVENTION

The present disclosure relates to liquid detergent compositions, especially liquid laundry detergent compositions having an improved rheology profile.

BACKGROUND OF THE INVENTION

Liquid compositions, particularly aqueous detergent compositions comprising appreciable amounts of surfactants may be difficult to formulate, given their tendency to split into two or more phases, such as one or more surfactant-rich phases and a water-rich phase. Further technical difficulties may arise when particulate matter is to be suspended in surfactant-containing liquid compositions as particulates have a tendency to rise to the top or to settle to the bottom of the composition over time. Yet consumers delight in fluid detergents offering stabilized particulate materials which can deliver improved cleaning performance, fabric care benefits, appearance benefits, and/or visual or aesthetic cues. Moreover, consumers typically prefer a higher, less water-like viscosity, since such rheology profiles connote improved formula richness.

In addition, a higher viscosity improves pretreatment where the laundry detergent composition is applied directly onto the fabric, since a higher viscosity ensures that the composition remains in the vicinity of the stain.

Crystallizable glycerides including hydrogenated castor oil (HCO, Thixcin R®, castor wax, trihydroxystearin) have been used as a rheology-modifying agent or external structurant for many years. When crystallized to fiber/thread—like crystals, HCO can stabilize liquid compositions and prevent separation from the liquid phase or prevent coagulation of liquid crystals or suspended particles.

Thickeners, such as polymeric thickeners, have also been used as rheology modifying agents. However, while such thickeners provide a higher viscosity, they typically do not provide sufficient low-shear viscosity to improve the phase stability of the composition or suspend particles.

In addition, higher levels of external structurants and/or thickeners, while providing an improved rheology profile, lead to compositions which are typically less readily dispersed in the wash liquor.

This is particularly challenging for short cycle and low temperature wash cycles.

Hence, a need remains for structured and/or thickened liquid compositions which provide an improved rheology profile. A further need remains for structured and thickened liquid compositions which are readily dispersed when added to the wash liquor, even during short cycle and low temperature wash cycles.

Stain removal compositions which comprise mixtures of grease-cutting solvents and polyamines for removing stains comprising a mixture of grease and particulate matter from fabrics are known. C5-15-alkanols in foam inhibitors for biodiesel fuel or diesel fuel-biodiesel blends are known. The use of an alkoxylate of 2-propyl-1-heptanol for degreasing is known. Multi-purpose aqueous cleaning compositions comprising hydrogen peroxide, a 2-alkyl alkanol, a hydrophobic surfactant having an HLB below 14 and an anionic surfactant are known. Solvent-based detergent compositions which consist essentially of 10-80% liquid aliphatic chlorinated hydrocarbon solvents, 10-40% liquid aliphatic ketones and/or liquid aliphatic esters, 6 to 50% water soluble liquid alkanols having two to five carbon atoms and 1-10% surface active agents are known. Emulsions for cleaning, the emulsions containing water, one or more anionic surfactants from a group of selected molecular weight carboxylic acid salts, and one or more organic solvents so that the compositions have low conductivity and low viscosity, are known.

A liquid crystal composition comprising a water insoluble organic compound, a nonionic surfactant, magnesium sulfate, a water soluble cosurfactant, an abrasive, an ethoxylated alkyl ether sulfate surfactant or alkyl sulfate surfactant, a fatty acid, a 2-alkyl alkanol and water is known. The use of an alcohol in a liquid cleaning composition comprising surfactant, for cleaning hydrophobic stains from surfaces and/or for providing suds longevity, wherein the alcohol is selected from the group consisting of: C4-C6 linear mono-alcohols, branched C4-C10 mono-alcohols having one or more C 1-C4 branching groups, alkyl mono-glycerols, and mixtures thereof, is known.

SUMMARY OF THE INVENTION

The present disclosure relates to a liquid detergent composition comprising: detersive surfactant anionic surfactant, nonionic surfactant, zwitterionic surfactant, and combinations thereof; an external structurant or thickener, solvent selected from the group consisting of: C4-C10 alkyl branched alcohols, and mixtures thereof, wherein "C4-C10 alkyl" refers to the primary alkyl chain, and refers to the weight average alkyl chain length; and wherein the composition has a pH of less than 8.9.

The present disclosure further relates to a method of laundering fabric, comprising the steps of: providing a liquid detergent composition according to any preceding claim; adding the laundry detergent composition to an automatic laundry washing machine; adding fabric to the automatic laundry washing machine; and washing the fabric using a wash cycle having a duration of from 10 to 40 minutes, preferably from 15 to 25 minutes, preferably wherein the wash water is at a temperature of less than 40° C., preferably less than 30° C., more preferably less than 21° C.

The present disclosure further relates to the use of solvent selected from the group consisting of: C4-C10 alkyl branched alcohols, and mixtures thereof, for improving the rheology of a liquid detergent composition.

DETAILED DESCRIPTION OF THE INVENTION

Liquid detergent compositions comprising an external structuring agent and/or a thickener, in combination with C4-C10 alkyl branched alcohols, and mixtures thereof, have been found to provide an improved rheology profile. Moreover, the C4-C10 alkyl branched alcohols have been found to improve the viscosity while not affecting the dispersibility of the liquid detergent composition. In addition, such compositions have been found to provide improved low shear viscosity, and hence, improved suspension of particulates and improved phase stability.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

All measurements are performed at 25° C. unless otherwise specified.

As used herein, the articles including "a" and "an" when used in a claim, are understood to mean one or more of what is claimed or described.

Detergent Composition:

As used herein, "liquid detergent composition" refers to liquid detergent composition which is fluid, and preferably capable of wetting and cleaning a fabric, e.g., clothing in a domestic washing machine. As used herein, "laundry detergent composition" refers to compositions suitable for washing clothes. The composition can include solids or gases in suitably subdivided form, but the overall composition excludes product forms which are non-fluid overall, such as tablets or granules. The liquid detergent composition preferably has a density in the range from 0.9 to 1.3 grams per cubic centimeter, more specifically from 1.00 to 1.10 grams per cubic centimeter, excluding any solid additives but including any bubbles, if present.

Aqueous liquid laundry detergent compositions are preferred. For such aqueous liquid laundry detergent compositions, the water content can be present at a level of from 5% to 99%, preferably from 15% to 90%, more preferably from 25% to 80% by weight of the liquid detergent composition.

The pH range of the detergent composition less than 8.9, preferably from 6.0 to 8.9, more preferably from pH 7 to 8.8. Such pH levels minimise fabric damage during pretreatment, especially for delicate fabrics and the colour of delicate fabrics.

Detersive Surfactants

Detersive surfactant as used herein means surfactants or mixtures of surfactants that provide cleaning, stain removing, or laundering benefit to soiled material. Suitable detersive surfactants are: anionic surfactant, nonionic surfactant, zwitterionic surfactant, and combinations thereof. Preferably, the surfactants are selected from the group consisting of: anionic surfactants, nonionic surfactants and combinations thereof.

The laundry composition can comprises detersive surfactant at a level of from 1 wt % to 70 wt %, preferably from 10 wt % to 50 wt %, more preferably from 15 wt % to 35 wt %.

Suitable anionic surfactants can be selected from the group consisting of: alkyl sulphates, alkyl ethoxy sulphates, alkyl sulphonates, alkyl benzene sulphonates, fatty acids and their salts, and mixtures thereof. However, by nature, every anionic surfactant known in the art of detergent compositions may be used, such as disclosed in "Surfactant Science Series", Vol. 7, edited by W. M. Linfield, Marcel Dekker. However, the composition preferably comprises at least a sulphonic acid surfactant, such as a linear alkyl benzene sulphonic acid, but water-soluble salt forms may also be used. Alkyl ethoxy sulphates, or mixtures thereof, are also preferred.

Anionic sulfonate or sulfonic acid surfactants suitable for use herein include the acid and salt forms of linear or branched alkylbenzene sulfonates, alkyl ester sulfonates, alkane sulfonates, alkyl sulfonated polycarboxylic acids, and mixtures thereof. Suitable anionic sulfonate or sulfonic acid surfactants include: C5-C20 alkylbenzene sulfonates, more preferably C10-C16 alkylbenzene sulfonates, more preferably C11-C13 alkylbenzene sulfonates, C5-C20 alkyl ester sulfonates, C6-C22 primary or secondary alkane sulfonates, C5-C20 sulfonated polycarboxylic acids, and mixtures thereof, but preferably C11-C13 alkylbenzene sulfonates. The aforementioned surfactants can vary widely in their 2-phenyl isomer content.

Anionic sulphate salts suitable for use in the compositions of the invention include the primary and secondary alkyl sulphates, having a linear or branched alkyl or alkenyl moiety having from 9 to 22 carbon atoms or more preferably 12 to 18 carbon atoms. Also useful are beta-branched alkyl sulphate surfactants or mixtures of commercial available materials, having a weight average (of the surfactant or the mixture) branching degree of at least 50%.

Mid-chain branched alkyl sulphates or sulfonates are also suitable anionic surfactants for use in the compositions of the invention. Preferred are the C5-C22, preferably C10-C20 mid-chain branched alkyl primary sulphates. When mixtures are used, a suitable average total number of carbon atoms for the alkyl moieties is preferably within the range of from greater than 14.5 to 17.5. Preferred mono-methyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used.

Other suitable anionic surfactants for use herein include fatty methyl ester sulphonates and/or alkyl alkoxylated sulphates such as alkyl ethoxy sulphates (AES) and/or alkyl polyalkoxylated carboxylates (AEC). When used, the alkyl alkoxylated sulphate surfactant is preferably a blend of one or more alkyl ethoxylated sulphates. Suitable alkyl alkoxylated sulphates include C10-C18 alkyl ethoxylate, more preferably C12-C15 alkyl ethoxylate, with a degree of ethoxylation of from 1 to 5, preferably from 1.8 to 4.

The anionic surfactants are typically present in the form of their salts with alkanolamines or alkali metals such as sodium and potassium.

For improved stability and grease cleaning, the liquid detergent composition can comprise linear alkyl benzene sulfonate surfactant and alkyl alkoxylated sulphate surfactant, such that the ratio of linear alkyl benzene sulfonate surfactant to alkyl alkoxylated sulphate surfactant is from 0.1:1 to 5:1, preferably from 0.25:1 to 3:1, more preferably from 0.6:1 to 1.1:1.

The liquid detergent composition can comprise nonionic surfactant. The level of nonionic surfactant in the liquid detergent composition can be present at a level of less than 10 wt %, preferably less than 5 wt %, more preferably less than 1 wt %, most preferably less than 0.5 wt %.

Suitable nonionic surfactants include, but are not limited to C12-C18 alkyl ethoxylates ("AE") including the so-called narrow peaked alkyl ethoxylates and C6-C12 alkyl phenol alkoxylates (especially ethoxylates and mixed ethoxy/propoxy), block alkylene oxide condensate of C6-C12 alkyl phenols, alkylene oxide condensates of C8-C22 alkanols and ethylene oxide/propylene oxide block polymers (Pluronic—BASF Corp.), as well as semi polar nonionics (e g, amine oxides and phosphine oxides) can be used in the present compositions. An extensive disclosure of these types of surfactants is found in U.S. Pat. No. 3,929,678, Laughlin et al., issued Dec. 30, 1975.

Alkylpolysaccharides such as disclosed in U.S. Pat. No. 4,565,647 Llenado are also useful nonionic surfactants in the compositions of the invention.

Also suitable are alkyl polyglucoside surfactants.

Nonionic surfactants of use include those of the formula $R_1(OC_2H_4)_nOH$, wherein $R_1$ is a C10-C16 alkyl group or a C8-C12 alkyl phenyl group, and n is from preferably 3 to 80. In some embodiments, the nonionic surfactants may be condensation products of C12-C15 alcohols with from 5 to 20 moles of ethylene oxide per mole of alcohol, e.g., C12-C13 alcohol condensed with 6.5 moles of ethylene oxide per mole of alcohol Suitable amine oxide surfactants are amine oxides having the following formula: $R_1R_2R_3NO$ wherein $R_1$ is an hydrocarbon chain comprising from 1 to 30 carbon atoms, preferably from 6 to 20, more preferably from 8 to 16 and wherein $R_2$ and $R_3$ are independently saturated or unsaturated, substituted or unsubstituted, linear or branched hydrocarbon chains comprising from 1 to 4 carbon atoms, preferably from 1 to 3 carbon atoms, and more preferably are methyl groups. $R_1$ may be a saturated or unsaturated, substituted or unsubstituted linear or branched hydrocarbon chain.

Suitable amine oxides for use herein are for instance preferably $C_{12}$-$C_{14}$ dimethyl amine oxide, commercially available from Albright & Wilson, $C_{12}$-$C_{14}$ amine oxides commercially available under the trade name Genaminox® LA from Clariant or AROMOX® DMC from AKZO Nobel. Additional suitable nonionic surfactants include polyhydroxy fatty acid amides of the formula:

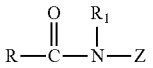

wherein R is a C9-17 alkyl or alkenyl, R1 is a methyl group and Z is glycidyl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798.

The liquid detergent composition can comprise a zwitterion. The zwitterion can be present at a level of from 0.1 wt % to 5 wt %, preferably from 0.2 wt % to 2 wt %, more preferably from 0.4 wt % to 1 wt %.

Suitable amphoteric or zwitterionic detersive surfactants include those which are known for use in hair care or other personal care cleansing. Non-limiting examples of suitable zwitterionic or amphoteric surfactants are described in U.S. Pat. No. 5,104,646 (Bolich Jr. et al.), U.S. Pat. No. 5,106,609 (Bolich Jr. et al.). Suitable amphoteric detersive surfactants include those surfactants broadly described as derivatives of aliphatic secondary and tertiary amines in which the aliphatic radical can be straight or branched chain and wherein one of the aliphatic substituents contains from 8 to 18 carbon atoms and one contains an anionic group such as carboxy, sulfonate, sulfate, phosphate, or phosphonate. Suitable amphoteric detersive surfactants for use in the present invention include, but are not limited to: cocoamphoacetate, cocoamphodiacetate, lauroamphoacetate, lauroamphodiacetate, and mixtures thereof.

Preferably surfactants comprising saturated alkyl chains are used.

Solvent

Suitable solvents are selected from the group consisting of: C4-C10 alkyl branched alcohols, and mixtures thereof. Such solvents have been found to improve the rheological profile of liquid detergent compositions. In addition, the solvents have been found to improve grease removal in detergent compositions when used during pretreatment of fabrics. Even more surprisingly, detergent compositions comprising such solvents have been found to improve grease removal even when during washing without pretreatment, and even when the solvents are present at low levels. Detergent compositions comprising such solvents are particularly effective at removing oils or grease which are at least partially naturally derived, such as animal fat, vegetable fat, and mixtures thereof, from fabrics.

"C4-C10 alkyl" refers to the primary alkyl chain, and refers to the weight average alkyl chain length. Preferred C4-C10 alkyl branched alcohols are C4-C10 primary monoalcohols having one or more C1-C4 branching groups, preferably selected from the group consisting of: methyl butanol, ethyl butanol, methyl pentanol, ethyl pentanol, methyl hexanol, ethyl hexanol, propyl hexanol, dimethyl hexanol, trimethyl hexanol, methyl heptanol, ethyl heptanol, propyl heptanol, dimethyl heptanol, trimethyl heptanol, methyl octanol, ethyl octanol, propyl octanol, butyl octanol, dimethyl octanol, trimethyl octanol, methyl nonanol, ethyl nonanol, propyl nonanol, butyl nonanol, dimethyl nonanol, trimethyl nonanol and mixtures thereof.

More preferred C4-C10 alkyl branched alcohols are C6-C8 alkyl branched alcohols, preferably selected from the group consisting of: methyl hexanol, ethyl hexanol, propyl hexanol, dimethyl hexanol, trimethyl hexanol, methyl heptanol, ethyl heptanol, propyl heptanol, dimethyl heptanol, trimethyl heptanol, methyl octanol, ethyl octanol, propyl octanol, butyl octanol, dimethyl octanol, trimethyl octanol, and mixtures thereof.

Even more preferred are C6-C7 alkyl branched alcohols, and mixtures thereof. Most preferably, the solvent is selected from the group consisting of: 2-ethylhexanol, 3,5,5-trimethyl-1-hexanol, 2-propylheptanol, and mixtures thereof.

The liquid detergent composition can comprise the solvent at a level of from 0.1 wt % to 10 wt %, preferably from 0.3 wt % to 7.5 wt %, preferably from 0.5 wt % to 5 wt % of the solvent.

For the present invention, alkanolamines, such as monoethanolamine and triethanolamine, are considered as alkali agents, or neutralising agents for anionic surfactants and the like, but not as solvents.

External Structurant or Thickener:

Preferred external structurants and thickeners are those that do not rely on charge—charge interactions for providing a structuring benefit. As such, particularly preferred external structurants are uncharged external structurants, such as those selected from the group consisting of: non-polymeric crystalline, hydroxyl functional structurants, such as hydrogenated castor oil; microfibrillated cellulose; uncharged hydroxyethyl cellulose; uncharged hydrophobically modified hydroxyethyl cellulose; hydrophobically modified ethoxylated urethanes; hydrophobically modified non-ionic polyols; and mixtures thereof.

Suitable non-polymeric crystalline, hydroxyl functional structurants are known in the art, and generally comprise a cystallizable glyceride which can be pre-emulsified to aid dispersion into the final liquid detergent composition. A non-limiting example of such a pre-emulsified external structuring system comprises: (a) crystallizable glyceride(s); (b) anionic surfactant; and (c) water and optionally, non-aminofunctional organic solvents. Each of these components is discussed in detail below. The preferred non-polymeric crystalline, hydroxy-functional structurant comprises a crystallizable glyceride, preferably hydrogenated castor oil or "HCO".

Suitable polymeric structurants include naturally derived and/or synthetic polymeric structurants.

Examples of naturally derived polymeric structurants of use in the present invention include: microfibrillated cellulose, hydroxyethyl cellulose, hydrophobically modified hydroxyethyl cellulose, carboxymethyl cellulose, polysaccharide derivatives and mixtures thereof. Non-limiting examples of microfibrillated cellulose are described in WO 2009/101545 A1. Suitable polysaccharide derivatives include: pectine, alginate, arabinogalactan (gum Arabic), carrageenan, gellan gum, xanthan gum, guar gum and mixtures thereof.

Examples of synthetic polymeric structurants or thickeners of use in the present invention include: polycarboxylates, hydrophobically modified ethoxylated urethanes (HEUr), hydrophobically modified non-ionic polyols and mixtures thereof.

Preferably the polycarboxylate polymer is a polyacrylate, polymethacrylate or mixtures thereof. In another preferred embodiment, the polyacrylate is a copolymer of unsaturated mono- or di-carbonic acid and 1-30C alkyl ester of the (meth) acrylic acid. Such copolymers are available from Noveon inc under the tradename Carbopol Aqua 30. Suitable polyacrylates include alkali swellable emulsion (ASE) thickeners and hydrophobically modified alkali sellable emulsion (HASE) thickeners. Suitable hydrophobically modified alkali swellable emulsions (HASE) are sold under the various brand names by Lubrizol Corporation, Clariant, Akzo Nobel, Coatex, 3V Sigma, SEPPIC, Ashland and BASF. Particularly suited, are Novethix L10 and Novethix HC200 (Lubrizol), Crystasense Sapphire (Clariant), Alcoguard 5800 (Akzo Nobel), Rheosolve 637 and Rheosolve 650 (Coatex), Polygel W30 (3V Sigma), Capige198 (SEPPIC), Jaypol AT4 (Ashland), Rheovis AT120, Salcare SC80 and Luvigel FIT (BASF)."

The branched solvents of the present invention have been surprisingly found to synergistically improve both the viscosity and yield strength provided by the external structurant or thickener. In addition, the branched alcohols have surprisingly been found to result in structuring in addition to thickening, when combined with polymeric thickeners.

Preferably, the aqueous liquid detergent composition has a viscosity of 50 to 5,000, preferably 75 to 1,000, more preferably 100 to 500 mPa·s, when measured at a shear rate of 100 s−1, at a temperature of 20° C. For improved phase stability, and also improved stability of suspended ingredients, the aqueous liquid detergent composition has a viscosity of 50 to 250,000, preferably 5,000 to 125,000, more preferably 10,000 to 35,000 mPa·s, when measured at a shear rate of 0.05 s−1, at a temperature of 20° C.

Optional Ingredients

The detergent composition may additionally comprise one or more of the following optional ingredients: enzymes, enzyme stabilizers, cleaning polymers, bleaching systems, optical brighteners, hueing dyes, particulate material, perfume and other odour control agents, hydrotropes, suds suppressors, fabric care benefit agents, pH adjusting agents, dye transfer inhibiting agents, preservatives, non-fabric substantive dyes and mixtures thereof. In more preferred embodiments, the laundry detergent composition does not comprise a bleach.

Cleaning polymers: Suitable cleaning polymers provide for broad-range soil cleaning of surfaces and fabrics and/or suspension of the soils. Any suitable cleaning polymer may be of use. Useful cleaning polymers are described in USPN 2009/0124528A1. Non-limiting examples of useful categories of cleaning polymers include: amphiphilic alkoxylated grease cleaning polymers; clay soil cleaning polymers; soil release polymers; and soil suspending polymers. The detergent composition may comprise amphiphilic alkoxylated grease cleaning polymers, which may have balanced hydrophilic and hydrophobic properties such that they remove grease particles from fabrics and surfaces. The amphiphilic alkoxylated grease cleaning polymers may comprise a core structure and a plurality of alkoxylate groups attached to that core structure. These may comprise alkoxylated polyalkyleneimines, for example. Such compounds may comprise, but are not limited to, ethoxylated polyethyleneimine, ethoxylated hexamethylene diamine, and sulfated versions thereof. Polypropoxylated derivatives may also be included. A wide variety of amines and polyalklyeneimines can be alkoxylated to various degrees. A useful example is 600 g/mol polyethyleneimine core ethoxylated to 20 EO groups per NH and is available from BASF. The alkoxylated polyalkyleneimines may have an inner polyethylene oxide block and an outer polypropylene oxide block. Other suitable cleaning polymers include polyester based soil release polymers, such as SRA300, supplied by Clariant. The detergent compositions may comprise from 0.1% to 10%, preferably, from 0.1% to 8%, more preferably from 0.1% to 6%, by weight of the detergent composition, of alkoxylated polyamines.

Polymer Deposition Aid: The liquid detergent composition can comprise from 0.1% to 7%, more preferably from 0.2% to 3%, of a polymer deposition aid. As used herein, "polymer deposition aid" refers to any cationic polymer or combination of cationic polymers that significantly enhance deposition of a fabric care benefit agent onto the fabric during laundering. Suitable polymer deposition aids can comprise a cationic polysaccharide and/or a copolymer. "Fabric care benefit agent" as used herein refers to any material that can provide fabric care benefits. Non-limiting examples of fabric care benefit agents include: silicone derivatives, oily sugar derivatives, dispersible polyolefins, polymer latexes, cationic surfactants and combinations thereof. Preferably, the deposition aid is a cationic or amphoteric polymer. The cationic charge density of the polymer preferably ranges from 0.05 milliequivalents/g to 6 milliequivalents/g. The charge density is calculated by dividing the number of net charge per repeating unit by the molecular weight of the repeating unit. In one embodiment, the charge density varies from 0.1 milliequivalents/g to 3 milliequivalents/g. The positive charges could be on the backbone of the polymers or the side chains of polymers.

Organic builder and/or chelant: The liquid detergent composition can comprise from 0.6% to 10%, preferably from 2 to 7% by weight of one or more organic builder and/or chelants. Suitable organic builders and/or chelants are selected from the group consisting of: MEA citrate, citric acid, aminoalkylenepoly(alkylene phosphonates), alkali metal ethane 1-hydroxy disphosphonates, and nitrilotrimethylene, phosphonates, diethylene triamine penta (methylene phosphonic acid) (DTPMP), ethylene diamine tetra (methylene phosphonic acid) (DDTMP), hexamethylene diamine tetra(methylene phosphonic acid), hydroxy-ethylene 1,1 diphosphonic acid (HEDP), hydroxyethane dimethylene phosphonic acid, ethylene di-amine di-succinic acid (EDDS), ethylene diamine tetraacetic acid (EDTA), hydroxyethylethylenediamine triacetate (HEDTA), nitrilotriacetate (NTA), methylglycinediacetate (MGDA), iminodisuccinate (IDS), hydroxyethyliminodisuccinate (HIDS), hydroxyethyliminodiacetate (HEIDA), glycine diacetate (GLDA), diethylene triamine pentaacetic acid (DTPA), catechol sulfonates such as Tiron™ and mixtures thereof.

Enzymes: Suitable enzymes provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, lignin-ases, pullulanases, tannases, pentosanases, malanases, β-glucanases, arabinosidases, hyaluronidase, chondroitinase, laccase, and known amylases, or combinations thereof. A preferred enzyme combination comprises a cocktail of conventional detersive enzymes such as protease, lipase, cutinase and/or cellulase in conjunction with amylase. Detersive enzymes are described in greater detail in U.S. Pat. No. 6,579,839.

Enzyme stabiliser: Enzymes can be stabilized using any known stabilizer system such as calcium and/or magnesium compounds, boron compounds and substituted boric acids, aromatic borate esters, peptides and peptide derivatives, polyols, low molecular weight carboxylates, relatively hydrophobic organic compounds [e.g. certain esters, diakyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl) serine salts; (meth)acrylic acid-(meth)acrylic acid ester copolymer and PEG; lignin compound, polyamide oligomer, glycolic acid or its salts; poly hexa methylene bi guanide or N,N-bis-3-amino-propyl-dodecyl amine or salt; and mixtures thereof.

Hueing dyes: The detergent composition may comprise fabric hueing agent (sometimes referred to as shading, bluing, or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and combinations thereof.

Optical brighteners: The detergent composition may comprise, based on the total detergent composition weight, from 0.005 to 2%, preferably 0.01 to 0.1% of a fluorescent agent (optical brightener). Fluorescent agents are well known and many fluorescent agents are available commercially. Usually, these fluorescent agents are supplied and used in the form of their alkali metal salts, for example, the sodium salts. Preferred classes of fluorescent agent are: Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazoline compounds, e.g. Blankophor SN. Preferred fluorescers are: sodium 2-(4-styryl-3-sulfophenyl)-2H-napthol[1,2-d]trazole, disodium 4,4'-bis{[(4-anilino-6-(N methyl-N-2 hydroxyethyl) amino 1,3,5-triazin-2-yl)]amino}stilbene-2-2' disulfonate, disodium 4,4'-bis{[(4-anilino-6-morpholino-1,3,5-triazin-2-yl)]annino}stilbene-2-2' disulfonate, and disodium 4,4'-bis(2-sulfoslyryl)biphenyl.

Hydrotrope: The detergent composition may comprise, based on the total detergent composition weight, from 0 to 30%, preferably from 0.5 to 5%, more preferably from 1.0 to 3.0%, which can prevent liquid crystal formation. The addition of the hydrotrope thus aids the clarity/transparency of the composition. Suitable hydrotropes comprise but are not limited to urea, salts of benzene sulphonate, toluene sulphonate, xylene sulphonate or cumene sulphonate. Preferably, the hydrotrope is selected from the group consisting of propylene glycol, xylene sulfonate, ethanol, and urea to provide optimum performance.

Particles: The composition can also comprise particles. The composition may comprise, based on the total composition weight, from 0.02% to 10%, preferably from 0.1% to 4%, more preferably from 0.25% to 2.5% of particles. Said particles include beads, pearlescent agents, microcapsules, and mixtures thereof.

Microcapsules: Suitable capsules are typically formed by at least partially, preferably fully, surrounding a benefit agent with a wall material. Preferably, the capsule is a perfume capsule, wherein said benefit agent comprises one or more perfume raw materials. The capsule wall material may comprise: melamine, polyacrylamide, silicones, silica, polystyrene, polyurea, polyurethanes, polyacrylate based materials, polyacrylate esters based materials, gelatin, styrene malic anhydride, polyamides, aromatic alcohols, polyvinyl alcohol, resorcinol-based materials, poly-isocyanate-based materials, acetals (such as 1,3,5-triol-benzene-gluteraldehyde and 1,3,5-triol-benzene melamine), starch, cellulose acetate phthalate and mixtures thereof. Preferably, the capsule wall comprises melamine and/or a polyacrylate based material. The perfume capsule may be coated with a deposition aid, a cationic polymer, a non-ionic polymer, an anionic polymer, or mixtures thereof. Preferably, the perfume capsules have a volume weighted mean particle size from 0.1 microns to 100 microns, preferably from 0.5 microns to 60 microns. Especially where the composition comprises capsules having a shell formed at least partially from formaldehyde, the composition can additionally comprise one or more formaldehyde scavengers.

Process of Making the Liquid Detergent Composition:

The laundry detergent compositions can be made using any suitable process known to the skilled person. Typically, the ingredients are blended together in any suitable order. Preferably, the detersive surfactants are added as part of a concentrated premix, to which are added the other optional ingredients. Preferably, the solvent is added before the external structurant and/or thickener is added, with the external structurant being added as the last ingredient.

Method of Laundering Fabrics:

The laundry detergent compositions of the present invention can be used to launder fabrics. In such methods, the laundry detergent composition can be diluted to provide a wash liquor having a total surfactant concentration of greater than 300 ppm, preferably from 400 ppm to 2,500 ppm, more preferably from 600 ppm to 1000 ppm. The fabric can then be washed in the wash liquor, and preferably rinsed.

The fabrics are preferably washed in automatic laundry washing machines. Since the compositions of the present invention are more readily dispersed, the compositions are more suitable for use in short cycles having a duration of from 10 to 40 minutes, or even from 15 to 25 minutes.

Methods:

A) pH Measurement:

The pH is measured, at 25° C., using a Santarius PT-10P pH meter with gel-filled probe (such as the Toledo probe, part number 52 000 100), calibrated according to the instructions manual.

B) Method of Measuring Viscosity:

The viscosity is measured using an AR 2000 rheometer from TA instruments using a cone and plate geometry with a 40 mm diameter and an angle of 1°. The viscosity at the different shear rates is measured via a logarithmic shear rate sweep from 0.1 $s^{-1}$ to 1200 $s^{-1}$ in 3 minutes time at 20° C. Low shear viscosity is measured at a continuous shear rate of 0.05 $s^{-1}$.

Examples:

The following liquid detergent compositions were prepared by simple mixing, with examples 1a to 3a and Aa to Ca comprising no external structurant or thickener, examples 1b to 3b and Ab to Cb comprising hydrogenated castor oil (HCO) as a structurant, and examples 1c to 3c and Ac to Ac comprising Rheovis AT120 as a thickener. Examples 1a to 3a, 1b to 3b, and 1c to 3c were of the invention, while examples Aa to Ca, Ab to Cb, and Ac to Cc were comparative:

| | Ex. 1a wt % | Ex. 2a wt % | Ex. 3a wt % | Ex. Aa* wt % | Ex. Ba* wt % | Ex. Ca* wt % |
|---|---|---|---|---|---|---|
| Linear C10-C12 alkyl benzene sulfonate | 4.8 | 4.8 | 4.8 | 4.8 | 4.8 | 4.8 |
| C12-C14 alkyl ethoxylated (EO3) sulfate | 2.2 | 2.2 | 2.2 | 2.2 | 2.2 | 2.2 |
| C45 EO7 ethoxylated nonionic surfactant | 3.6 | 3.6 | 3.6 | 3.6 | 3.6 | 3.6 |
| Topped kernel fatty acid | 2.5 | 2.5 | 2.5 | 2.5 | 2.5 | 2.5 |
| Citric acid | 1.7 | 1.7 | 1.7 | 1.7 | 1.7 | 1.7 |
| 2-propylheptanol | 0.5 | 1 | 2 | — | — | — |
| 1,2-propanediol | — | — | — | 0.5 | 1 | 2 |
| Sodium hydroxide | pH 8.4 | pH 8.4 | pH 8.4 | pH 8.4 | pH 8.4 | pH 8.4 |
| Water | to 100% | to 100% | to 100% | to 100% | to 100% | to 100% |
| Viscosity (0.05/s) mPa · s | 136 | 791 | 5006 | 78 | 70 | 129 |
| Viscosity (1/s) mPa · s | 35 | 124 | 848 | 11 | 8 | 16 |
| Viscosity (20/s) mPa · s | 39 | 51 | 66 | 12 | 11 | 10 |
| Viscosity (100/s) mPa · s | 37 | 40 | 30 | 11 | 11 | 10 |

Comparing examples 1a to 3a with examples Aa to Ca, it can be seen that the branched solvent improves the viscosity of the compositions. In addition, the low shear viscosity is improved, which results in improved structuring and suspension of ingredients such as particulates.

| | Ex. 1b wt % | Ex. 2b wt % | Ex. 3b wt % | Ex. Ab* wt % | Ex. Bb* wt % | Ex. Cb* wt % |
|---|---|---|---|---|---|---|
| Linear C10-C12 alkyl benzene sulfonate | 4.8 | 4.8 | 4.8 | 4.8 | 4.8 | 4.8 |
| C12-C14 alkyl ethoxylated (EO3) sulfate | 2.2 | 2.2 | 2.2 | 2.2 | 2.2 | 2.2 |
| C45 EO7 ethoxylated nonionic surfactant | 3.6 | 3.6 | 3.6 | 3.6 | 3.6 | 3.6 |
| Topped kernel fatty acid | 2.5 | 2.5 | 2.5 | 2.5 | 2.5 | 2.5 |
| Citric acid | 1.7 | 1.7 | 1.7 | 1.7 | 1.7 | 1.7 |
| 2-propylheptanol | 0.5 | 1 | 2 | — | — | — |
| 1,2-propanediol | — | — | — | 0.5 | 1 | 2 |
| Hydrogenated Castor Oil | 0.32 | 0.32 | 0.32 | 0.32 | 0.32 | 0.32 |
| Sodium hydroxide | pH 8.4 | pH 8.4 | pH 8.4 | pH 8.4 | pH 8.4 | pH 8.4 |
| Water | to 100% | to 100% | to 100% | to 100% | to 100% | to 100% |
| Viscosity (0.05/s) mPa · s | 16620 | 22480 | 22610 | 11170 | 10540 | 10940 |
| Viscosity (1/s) mPa · s | 1123 | 1533 | 1942 | 714 | 673 | 711 |
| Viscosity (20/s) mPa · s | 185 | 228 | 219 | 90 | 88 | 89 |
| Viscosity (100/s) mPa · s | 109 | 109 | 79 | 45 | 44 | 45 |

Comparing examples 1b to 3b with examples Ab to Cb, it can be seen that the branched solvent synergistically combine with structurants to further improve the viscosity of such compositions. In addition, the low shear viscosity is further improved, which results in improved structuring and suspension of ingredients such as particulates, as well as improved stability.

| | Ex. 1c wt % | Ex. 2c wt % | Ex. 3c wt % | Ex. Ac* wt % | Ex. Bc* wt % | Ex. Cc* wt % |
|---|---|---|---|---|---|---|
| Linear C10-C12 alkyl benzene sulfonate | 4.8 | 4.8 | 4.8 | 4.8 | 4.8 | 4.8 |
| C12-C14 alkyl ethoxylated (EO3) sulfate | 2.2 | 2.2 | 2.2 | 2.2 | 2.2 | 2.2 |
| C45 EO7 ethoxylated nonionic surfactant | 3.6 | 3.6 | 3.6 | 3.6 | 3.6 | 3.6 |
| Topped kernel fatty acid | 2.5 | 2.5 | 2.5 | 2.5 | 2.5 | 2.5 |
| Citric acid | 1.7 | 1.7 | 1.7 | 1.7 | 1.7 | 1.7 |
| 2-propylheptanol | 2 | 2 | 1 | — | — | — |
| 1,2-propanediol | — | — | — | 2 | 2 | 1 |
| Rheovis AT120 | 0.09 | 0.38 | 0.67 | 0.09 | 0.38 | 0.67 |
| Sodium hydroxide | pH 8.4 | pH 8.4 | pH 8.4 | pH 8.4 | pH 8.4 | pH 8.4 |
| Water | to 100% | to 100% | to 100% | to 100% | to 100% | to 100% |
| Viscosity (0.05/s) mPa · s | 3671 | 33290 | 9814 | 75 | 213 | 554 |
| Viscosity (1/s) mPa · s | 1132 | 3925 | 1903 | 15 | 61 | 409 |
| Viscosity (20/s) mPa · s | 177 | 498 | 589 | 13 | 50 | 296 |
| Viscosity (100/s) mPa · s | 68 | 184 | 303 | 14 | 46 | 233 |

Comparing examples 1c to 3c with examples Ac to Cc, it can be seen that the branched solvent synergistically works with thickeners to further improve the viscosity of such compositions. From the low shear data of examples Ac to Cc, it can be seen that thickeners, including polymeric thickeners, provide virtually no structuring benefit. Surprisingly, as can be seen from the viscosity data of examples 1c to 3c, the addition of the branched alcohol results in the composition being structured, and able to suspend particulates.

Examples 4 to 9 are non-limiting embodiments of the present invention. Percentages are by weight unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is

| | Ex. 4 wt % | Ex. 5 wt % | Ex. 6 wt % | Ex. 7 wt % | Ex. 8 wt % | Ex. 9 wt % |
|---|---|---|---|---|---|---|
| C12-14 EO3 alkyl ethoxylated sulfate | 9.8 | 4.0 | 0.6 | 7.1 | 9.1 | 3.4 |
| C12-15 linear alkylbenzene sulfonic acid | 14.5 | 9.2 | 5.9 | 10.8 | 6.9 | 4.6 |
| C12-15 EO8 ethoxylated alcohol | 2.0 | 4.0 | 3.0 | 7.0 | 6 | 4.6 |
| Dodecydimethylamine-N-oxide | 0 | 0.5 | 0 | 0 | 0 | 0 |
| Citric Acid | 4.8 | 2.8 | 1.9 | 2.8 | 3.3 | 2.2 |
| C12-18 Fatty Acid | 3.3 | 1.7 | 1.2 | 4.7 | 4.9 | 1.6 |
| Sodium Cumene Sulfonate | 0 | 1.7 | 0.2 | 0 | 0 | 0 |
| Zwitterionic polyamine[1] | 0.7 | 0.7 | 0.3 | 0 | 0 | 0 |
| Diethylenetriamine penta(methylene phosphonic acid), Sodium salt (DTPMP) | 0 | 0.5 | 0.2 | 0 | 0.5 | 0.2 |
| 1-hydroxyethane 1,1-diphosphonic acid (HEDP) | 0.6 | 0 | 0 | 2.0 | 0 | 0 |
| Mannanase[2] | 0.003 | 0.002 | 0 | 0 | 0.0002 | 0.002 |
| Amylase[3] | 0.013 | 0.004 | 0.0016 | 0 | 0.02 | 0.005 |
| Protease[4] | 0.039 | 0.02 | 0.018 | 0 | 0.06 | 0.008 |
| Cellulase[5] | 0 | 0 | 0 | 0 | 0.006 | 0 |
| Pectate Lyase[6] | 0.005 | 0.002 | 0 | 0 | 0.001 | 0 |
| Lipase[7] | 0 | 0 | 0 | 0 | 0.010 | 0 |
| PEG-PVAc Polymer[8] | 1.9 | 1.3 | 0.9 | 0 | 0 | 0 |
| Di-ethoxylated poly (1,2 propylene terephtalate) short block soil release polymer[9] | 0 | 0 | 0 | 0 | 0.55 | 0 |
| Ethoxylated Polyethylenimine[10] | 0 | 0 | 0 | 1.2 | 0 | 0 |
| Brightener 49 | 0.08 | 0.05 | 0.05 | 0.24 | 0 | 0.05 |
| Bis azo or azo thiophene hueing dye[11] | 0 | 0 | 0.02 | 0 | 0 | 0 |
| Hydrogenated castor oil | 1 | 0.30 | 0.44 | 0 | 0 | 0 |
| 2-propylheptanol | 5 | — | — | 6 | 1 | 0.5 |
| 2-ethylhexanol | — | 2 | — | — | — | 1 |
| 3,5,5-trimethyl-1-hexanol | — | — | 3 | — | 4 | — |
| 1,2 propanediol | 8.3 | 1.3 | 1.0 | 9.2 | 6.1 | 3.6 |
| Ethanol | 0 | 0 | 0.5 | 0 | 1.9 | 0 |
| Glycerine | 0 | 0 | 0 | 0.5 | 0.3 | 1.0 |
| Sodium formate | 0 | 0.03 | 0.3 | 0 | 0 | 0 |
| Calcium Chloride | 0.03 | 0.01 | 0.006 | 0 | 0 | 0 |
| Boric acid | 0 | 0 | 0 | 0 | 1.1 | 1.8 |
| Monoethanolamine | 8.8 | 0.24 | 0.35 | 6.1 | 0 | 0 |
| Triethanolamine | 0 | 0 | 0 | 4.1 | 0 | 0 |
| Sodium hydroxide | to pH 7.4 | to pH 7.9 | to pH 8.0 | to pH 8.8 | to pH 8.5 | to pH 8.3 |
| Acticide MBS2550 | 0.003 | 0.001 | 0.001 | 0.01 | 0.03 | 0.02 |
| Silicone suds suppressor | 0 | 0.003 | 0.003 | 0 | 0 | 0.02 |
| Perfume microcapsules | 0 | 0.25 | 0 | 0 | 0 | 0 |
| Perfume | 1.5 | 0.9 | 0.6 | 2.0 | 1.0 | 0.8 |
| Dye | 0.009 | 0.005 | 0.004 | 0 | 0.005 | 0.002 |
| Water | to 100% | to 100% | to 100% | to 100% | to 100% | to 100% |

[1]Zwitterionic ethoxylated quaternized sulfated hexamethylene diamine, supplied by BASF, Germany

[2]Mannanase enzyme originating from Bacillus sp. I633 available from Novozymes, Denmark

[3]Termamyl ® Ultra, available from Novozymes, Denmark

[4]Protease enzyme from Bacillus Amyloliquefaciens as described in EP 0 130 756 B1 published Jan. 9, 1985

[5]Carezyme ® available from Novozymes, Denmark

[6]Pectawash ® 20L, supplied by Novozymes, Denmark

[7]Lipex ®, supplied by Novozymes, Denmark

[8]Polyvinyl acetate grafted polyethylene oxide copolymer having a polyethylene oxide backbone and multiple polyvinyl acetate side chains, supplied by BASF, Germany.

[9]TexCare ® SRN-100, supplied by Clariant, Germany

[10]Polyethyleneimine (MW = 600) with 20 ethoxylate groups per —NH, supplied by BASF 11Supplied by Milliken, USA prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition comprising:

a) from about 10 wt. % to about 50 wt. % of a detersive surfactant selected from anionic surfactant, nonionic surfactant, zwitterionic surfactant, and combinations thereof;

b) a structurant or synthetic polymeric thickener;

c) solvent comprising 2-ethylhexanol; 3,5,5-trimethyl-1-hexanol; 2-propylheptanol;

or a mixture thereof;

d) an alkoxylated polyalkyleneimine and wherein the composition has a pH of less than about 8.9 and is free of bleach.

2. The laundry detergent composition according to claim 1, wherein the solvent comprises 2-propyl heptanol.

3. The liquid detergent composition according to claim 1, wherein the composition comprises solvent at a level of from about 0.1 wt % to about 10 wt %.

4. The liquid detergent composition according to claim 1, wherein the detersive surfactant consists of anionic surfactant, non-ionic surfactant, or mixtures thereof.

5. The laundry detergent composition according to claim 1, wherein the anionic surfactant comprises linear alkyl benzene sulfonate and alkyl alkoxylated sulfate and the ratio of linear alkyl benzene sulfonate surfactant to alkyl alkoxylated sulphate surfactant is from about 0.1 to about 5.

6. The laundry detergent composition according to claim 5, wherein the ratio of linear alkyl benzene sulfonate surfactant to alkyl alkoxylated sulphate surfactant is from about 0.6 to about 1.1.

7. The liquid detergent composition according to claim 6, wherein the laundry composition comprises detersive surfactant at a level of from about 15 wt % to about 35 wt %.

8. The liquid detergent composition according to claim 1, wherein the liquid detergent composition comprises the external structurant or thickener is selected from the group consisting of: non-polymeric crystalline, hydroxyl functional structurants; microfibrillated cellulose; uncharged hydroxyethyl cellulose; uncharged hydrophobically modified hydroxyethyl cellulose; hydrophobically modified ethoxylated urethanes; polyacrylates; hydrophobically modified non-ionic polyols; and mixtures thereof.

9. The liquid detergent composition according to claim 1, wherein the laundry composition further comprises particles, selected from the group consisting of: beads, pearlescent agents, microcapsules, and mixtures thereof.

10. The liquid detergent composition according to claim 9, wherein the laundry composition further comprises microcapsules.

11. The liquid detergent composition according to claim 1, wherein the laundry composition comprises enzymes, enzyme stabilizers, cleaning polymers, optical brighteners, hueing dyes, particulate material, perfume and other odour control agents, hydrotropes, suds suppressors, fabric care benefit agents, pH adjusting agents, dye transfer inhibiting agents, preservatives, non-fabric substantive dyes, or a mixture thereof.

* * * * *